US009685741B2

(12) United States Patent
Wu et al.

(10) Patent No.: US 9,685,741 B2
(45) Date of Patent: Jun. 20, 2017

(54) CABLE CONNECTOR ASSEMBLY WITH IMPROVED METAL SHELL

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/054,159

(22) Filed: Feb. 26, 2016

(65) Prior Publication Data

US 2016/0254621 A1 Sep. 1, 2016

(30) Foreign Application Priority Data

Feb. 26, 2015 (CN) ..... 2015 1 0088247

(51) Int. Cl.
*H01R 9/03* (2006.01)
*H01R 13/6593* (2011.01)

(52) U.S. Cl.
CPC ..... *H01R 13/6593* (2013.01)

(58) Field of Classification Search
CPC H01R 13/6593; H01R 13/6585; H01R 12/62; H01R 27/02; H01R 9/034; G02B 6/3817
USPC ..... 439/607.47
See application file for complete search history.

(56) References Cited

U.S. PATENT DOCUMENTS 7,896,559 B2 * 3/2011 Yi ..... G02B 6/3817 385/49
8,152,566 B1 4/2012 Little et al.
8,439,575 B2 * 5/2013 He ..... G02B 6/3817 385/53
8,668,523 B2 3/2014 Wu
2004/0115988 A1 * 6/2004 Wu ..... H01R 12/62 439/497
2004/0157490 A1 * 8/2004 Wu ..... H01R 13/6585 439/497
2011/0312217 A1 * 12/2011 Xiao ..... H01R 27/02 439/607.23
2013/0109238 A1 * 5/2013 Li ..... H01R 9/034 439/625

* cited by examiner

*Primary Examiner* — Jean F Duverne
(74) *Attorney, Agent, or Firm* — Wei Te Chung; Ming Chieh Chang

(57) ABSTRACT

A cable connector assembly comprises a cable, a connector connected with the cable. The connector comprises a plurality of contacts electrically connecting the cable, an insulative housing retaining the contacts, a metal shell having a top shell and a bottom shell assembled with each other around the insulative housing, and a fixing member fixing the cable. The bottom shell includes a rear wall having a opening for the cable to be inserted into. The top shell includes a top wall and a tongue piece extending from the top wall to the cable. The fixing member includes a main body fastening the cable and a soldering portion extending from the main body and soldering with the rear wall of the bottom shell.

20 Claims, 6 Drawing Sheets

CABLE CONNECTOR ASSEMBLY WITH IMPROVED METAL SHELL

FIELD OF THE INVENTION

The Present Disclosure relates, generally, to a cable connector assembly, and, more particularly, to a cable connector assembly having an improved electromagnetic shield effect.

DESCRIPTION OF PRIOR ART

U.S. Pat. No. 8,152,566 published on Apr. 10, 2012 shows a cable connector assembly, which comprises an electrical connector and a cable connected to the connector. The electrical connector includes an insulative housing, a number of contacts retained in the insulative housing and a metal shell enclosing the insulative housing. The metal shell includes a top wall, a bottom wall mating with the top wall. The top wall includes a first fixing band extending from a rear end thereof. The bottom wall includes a second fixing band in the shape of T, extending out of the main body of the bottom wall. The second fixing band encloses and fastens both the first fixing band and the cable. However, the metal shell fails to shield EMI (Electro-Magnetic Interference) well in a joint of the first fixing band and the second fixing band.

Hence, a cable connector assembly having an improved electromagnetic shield effect is desired.

SUMMARY OF THE INVENTION

Accordingly, an object of the present invention is to provide a cable connector assembly having an improved electromagnetic shield effect.

In order to achieve the object set forth, a cable connector assembly in accordance with the present invention comprises a cable, a connector connected with the cable. The connector comprises a plurality of contacts electrically connecting the cable, an insulative housing retaining the contacts, a metal shell having a top shell and a bottom shell assembled with each other around the insulative housing, and a fixing member fixing the cable. The bottom shell includes a rear wall having a opening for the cable to be inserted into. The top shell includes a top wall and a tongue piece extending from the top wall to the cable. The fixing member includes a main body fastening the cable and a soldering portion extending from the main body and soldering with the rear wall of the bottom shell.

Other objects, advantages and novel features of the invention will become more apparent from the following detailed description when taken in conjunction with the accompanying drawings.

DETAILED DESCRIPTION OF PREFERRED EMBODIMENTS

Figure 1:
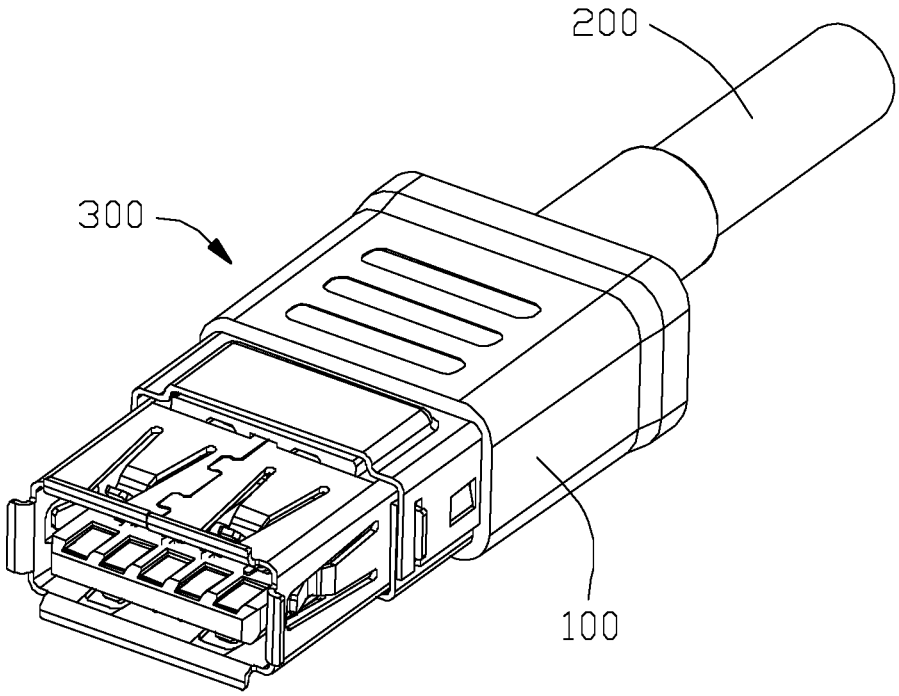
FIG. 1 is a perspective view of a cable connector assembly of the Present Disclosure.
Figure 2:
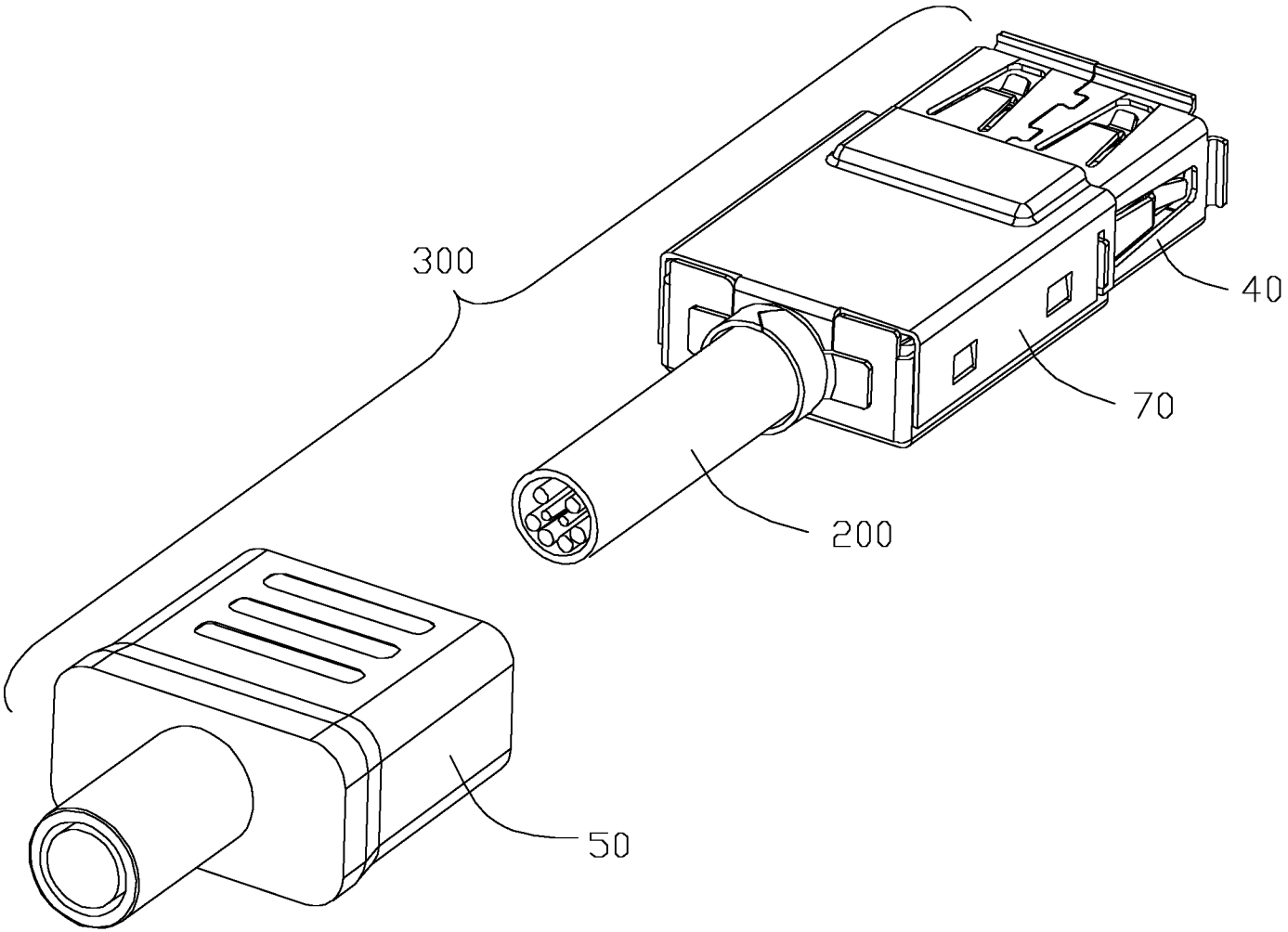
FIG. 2 is an exploded perspective view of the cable connector assembly of FIG. 1, showing an insulative shell disassembled from a cable connector assembly.

Reference will now be made in detail to the preferred embodiment of the present invention. Referring to FIGS. 1-4, a cable connector assembly 300 in accordance with the present invention comprises an electrical connector 100 and a cable 200 connecting with a rear end of the connector 100. The connector 100 comprises a plurality of contacts 20, an insulative housing 10 retaining the contacts 20, a wire-arranging block 60 installed at a rear end of the insulative housing 10, a conductive member 30 disposed at the wire-arranging block 60, an internal shielding shell 40 assembled around the insulative housing 10, a metal shell 70 assembled around both the wire-arranging block 60 and the internal shielding shell 40, and an insulative shell 50 injection molded on both the wire-arranging block 60 and the cable 200.

The metal shell 70 comprises a top shell or first part 71 and a bottom shell or second part 72 assembled with the top shell 71. The bottom shell 72 includes a rear wall 721 composed of two spaced halves with therebetween an upward U-shaped opening 722 which the cable 200 is downwardly inserted into. Notably, in this embodiment, the two halves of the rear wall 721 are respectively formed on and extending from the corresponding second side walls. The top shell 71 includes a top or main wall 710 and a tongue piece 712 extending therefrom vertically, the tongue piece 712 forms a downward arcuate opening 713 which combines with the U-shaped opening 722 into a whole loop around the cable 200. The arcuate opening 713 is configured to adapt to a surface of the cable 200 for a seamless junction. Along a transverse direction perpendicular both the vertical direction and the front-to-rear direction, a width of the tongue piece 712 is substantially equal to the U-shaped opening 722. Because the tongue piece 712 is coplanar with the rear wall 721 along the transverse direction, the tongue piece 712 may be deemed as a part of the rear wall 721.

The top shell 71 includes two first side walls 714 parallel to each other, perpendicular to the top wall 710. The bottom shell 72 includes a bottom or main wall 723, and two second side walls 724 parallel to each other perpendicular to the bottom shell 72. The first side walls 714 are disposed outside the second side walls 724. The first side walls 714 define a plurality of locking holes 715, and accordingly, the second side walls 724 form a plurality of tubers 725 locking to the locking holes 715. The internal shielding shell 40 includes a pair of tabs 41 disposed at two sides thereof in the transverse direction. Each first side wall 714 defines a top slit 716 which is open downward, and each second side wall 724 defines a bottom slit 726 which is open upward. The top slit 716 and the bottom slit 726 are opposite to each other in the vertical direction, and each tab 41 is received in both the top slit 716 and the bottom slit 726.

Figure 5:
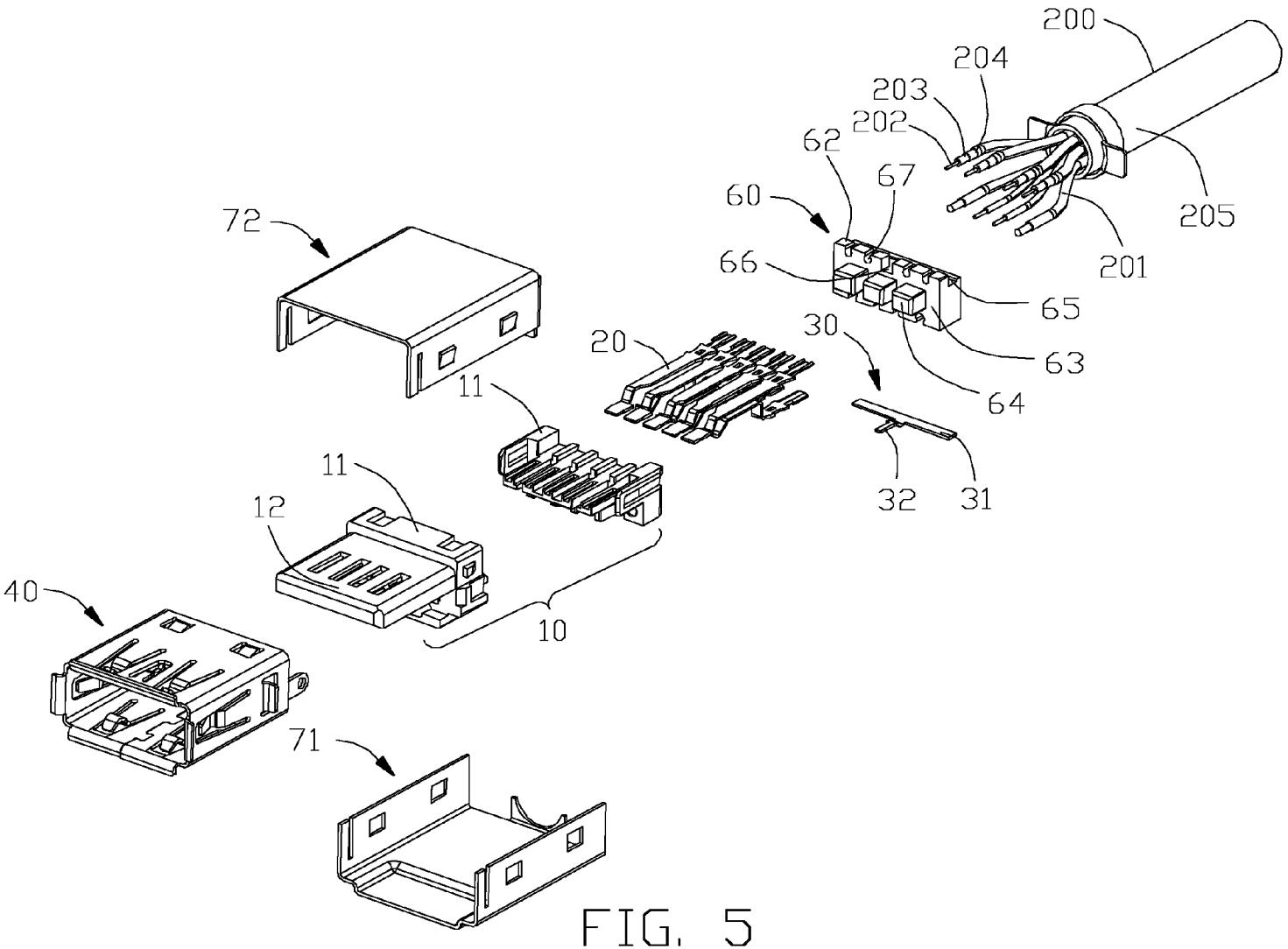
FIG. 5 is a further exploded perspective view of the cable connector assembly of FIG. 4, the insulative shell not shown.
Figure 6:
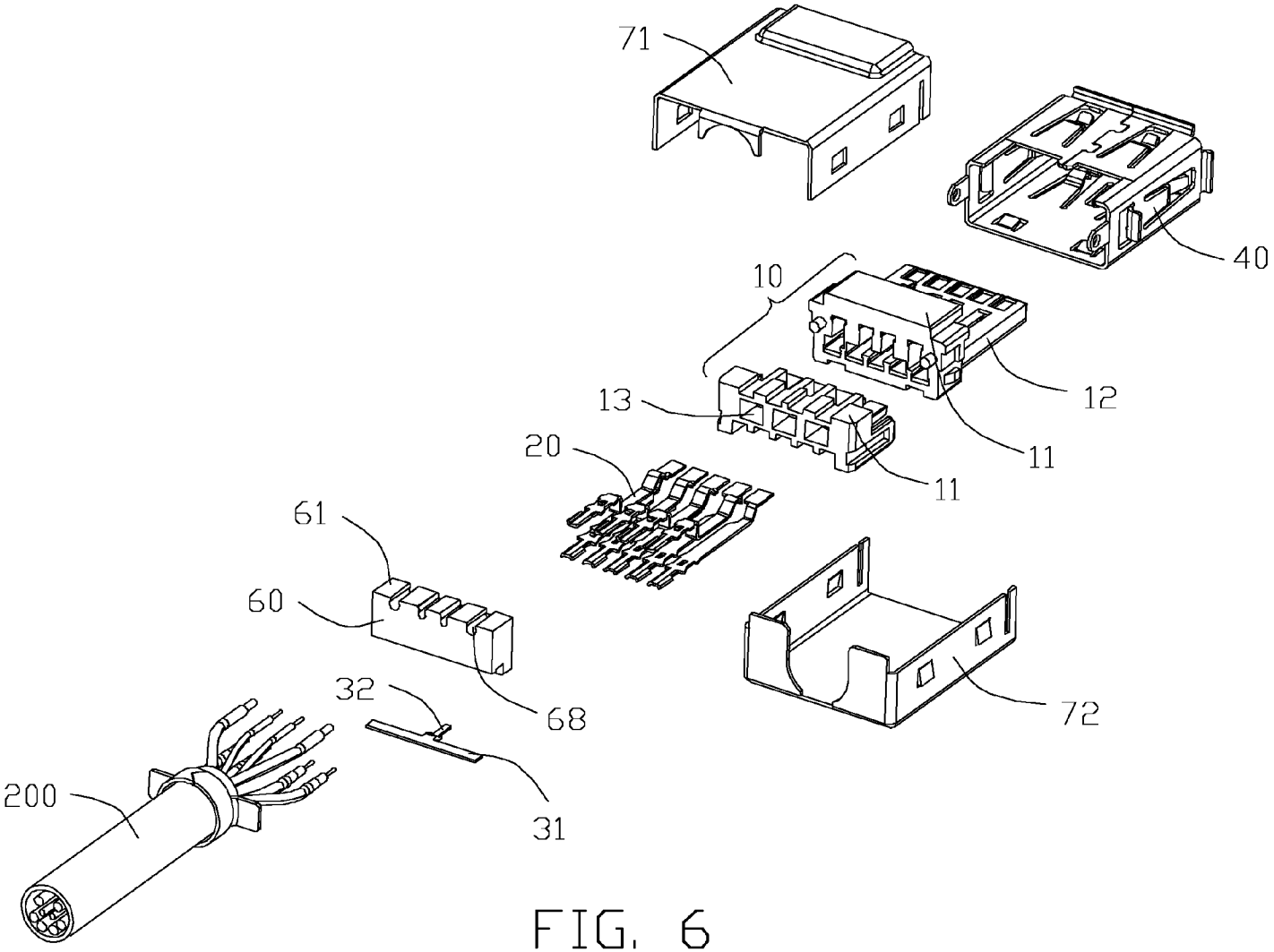
FIG. 6 is a another exploded perspective view of the cable connector assembly of FIG. 5, the insulative shell not shown.

Referring to FIGS. 5-6, the cable 200 includes a plurality of core wires 201 and an external sheath 205 around all the core wires 201, each of the core wires comprising a conductor 202 for transmitting signals, an insulative layer 203 around the conductor 202, and a grounding layer 204 around the insulative layer 203, wherein the conductor 202 extends outside of the grounding layer 204. It will be appreciated that, in this preferred embodiment, the connector 100 is up to a standard of USB 3.0 or a higher standard, and the core wires 201 are coaxial lines.

Figure 3:
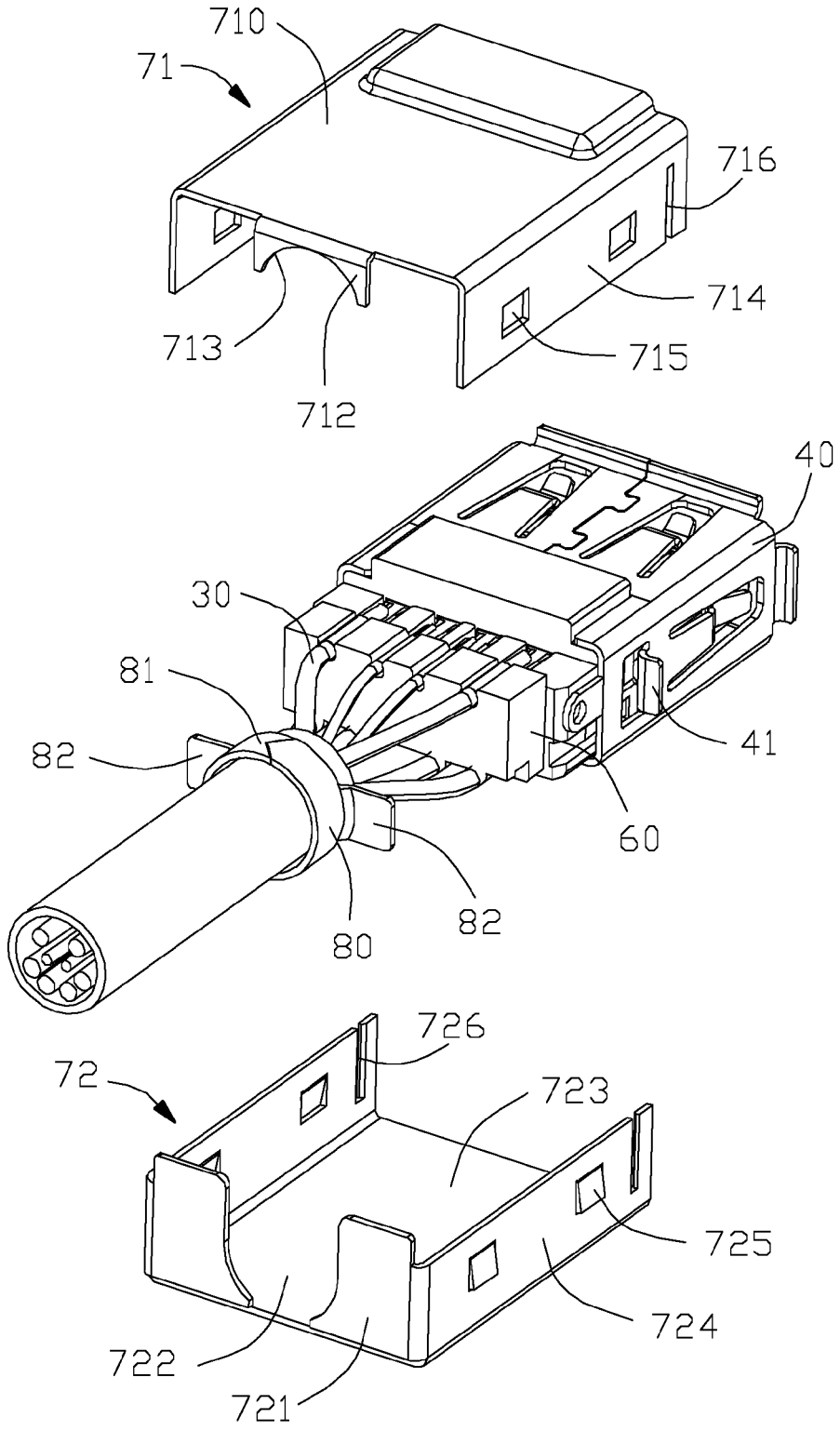
FIG. 3 is an exploded perspective view of the cable connector assembly of FIG. 2, the insulative shell not shown.
Figure 4:
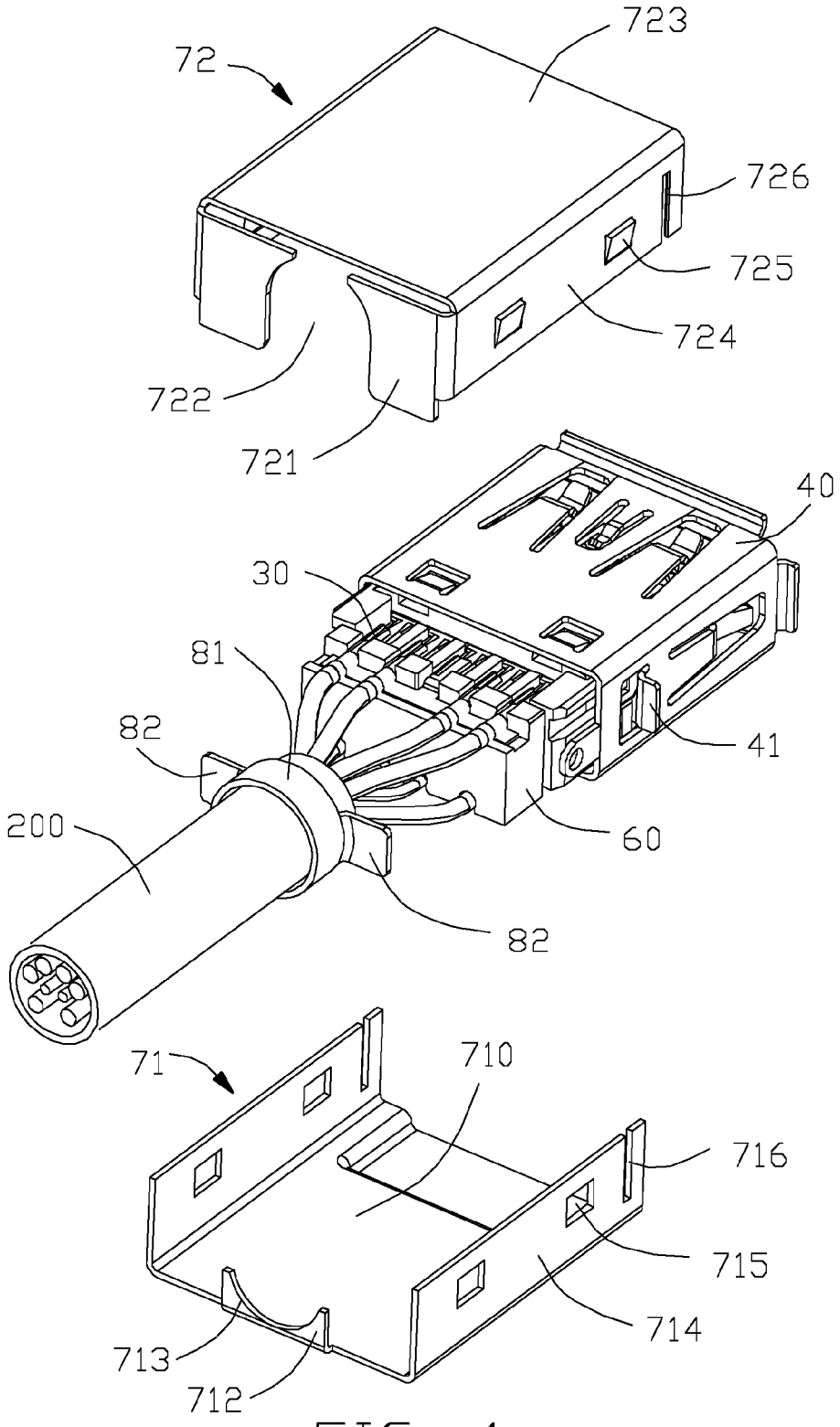
FIG. 4 is another exploded perspective view of the cable connector assembly of FIG. 3, the insulative shell not shown.

Referring to FIGS. 3-4, the cable connector assembly 300 also includes a fixing member 80 to fix the cable 200. The fixing member 80 includes a ring-shaped main body 81 fastening the cable 200 and a pair of soldering portions or ears 82 symmetrically extending from the main body 81 along the transverse direction. When assembling the cable 200 to the connector 100, rivet the main body 81 of the fixing member 80 with the grounding layers 204 of the cable 200, and then put the cable 200 into the bottom shell 72, and finally solder the soldering portion 82 of the fixing member 80 onto the rear wall 721 of the bottom shell 72 and the soldering portion 82 is positioned at two outsides of the U-shaped opening 722 in the transverse direction.

Referring to FIGS. 5-6, the insulative housing 10 includes a substrate 11 and a tongue plate 12 extending forwardly from the substrate 11. The height of the substrate 11 is bigger than the tongue plate 12 in the vertical direction. The insulative housing 10 forms three mounting holes 13 by depressing a rear end thereof. The wire-arranging block 60 includes a top surface 61, a bottom surface 62 opposite to the top surface 61 in the vertical direction, and a front surface 63 connecting the top surface 61 and the bottom surface 62. Three mounting columns 64 are formed by protruding from the front surface 63 of the wire-arranging block 60, which is mounted into the three mounting holes 13 respectively. On the bottom surface 62 of the wire-arranging block 60, there is a first recess 65, a second recess 66 extending forwardly from the first recess 65, and a plurality of first positioning slots 67 arranged at two sides of the second recess 66, wherein the first recess 65 and the second recess 66 runs through each other. The conductive member 30 includes a base 31 and a grounding portion 32 extending from the middle of the base 31 along the transverse direction. The base 31 is received in the first recess 65 and the grounding portion 32 is placed in and forwardly extends outside of the second recess 66 to electrically connect a specific contact 20. On the top surface 61 of the wire-arranging block 60, there is a plurality of second positioning slots 68, where the core wires 201 is received for positioning when soldering. It is understood that, the wire-arranging block 60 is assembled to the insulative housing 10, which facilitates manufacturing.

The grounding portion 32 of the conductive member 30 extends forwardly to electrically connect a grounding contact which transmits grounding signal. The base 31 of the conductive member 30 is longer than an arranging length of the contacts 20 along the transverse direction, which is useful for soldering the base 31 and the grounding layers 204 of the core wires 201 together.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable connector assembly, comprising:

a cable;

a connector connected with the cable, comprising a plurality of contacts electrically connecting the cable, an insulative housing retaining the contacts, a metal shell having a top shell and a bottom shell assembled with each other around the insulative housing, and a fixing member fixing the cable;

wherein the bottom shell includes a rear wall in a front-to-rear direction which has an opening for the cable to be inserted into, the top shell includes a top wall and a tongue piece extending from the top wall to the cable in a vertical direction, the tongue piece forms a downward opening to combine with said opening for snugly receiving said cable, and the fixing member includes a main body fastening the cable and a soldering portion extending from the main body and soldering with the rear wall of the bottom shell.

2. The cable connector assembly as claimed in claim 1, wherein the opening of the rear wall is U-shaped, and the cable is inserted into the U-shaped opening downwardly.

3. The cable connector assembly as claimed in claim 1, wherein said tongue piece is received in said opening, and the opening is not wider than the tongue piece along a transverse direction perpendicular to the vertical direction and the front-to-rear direction.

4. The cable connector assembly as claimed in claim 2, wherein the tongue piece forms a downward arcuate opening which combines with the U-shaped opening into a whole loop around the cable, and the arcuate opening is configured to adapt to a surface of the cable for a seamless junction.

5. The cable connector assembly as claimed in claim 4, wherein the cable includes a grounding layer, and the main body of the fixing member is riveted with the grounding layers, after that put the cable into the bottom shell, and finally solder the soldering portion of the fixing member onto the rear wall of the bottom shell.

6. The cable connector assembly as claimed in claim 5, wherein the main body is ring-shaped and the soldering portion symmetrically extends from the main body along a transverse direction perpendicular to both the vertical direction and the front-to-rear direction.

7. The cable connector assembly as claimed in claim 6, wherein the soldering portion is soldered at two outsides of the U-shaped opening in the transverse direction.

8. The cable connector assembly as claimed in claim 4, wherein the top shell includes two first side walls parallel to each other, perpendicular to the top wall; the bottom shell includes a bottom wall, and two second side walls parallel to each other perpendicular to the bottom shell; the first side walls are disposed outside the second side walls.

9. The cable connector assembly as claimed in claim 8, wherein the first side walls define a plurality of locking holes, and accordingly, the second side walls form a plurality of tubers locking to the locking holes.

10. The cable connector assembly as claimed in claim 9, wherein the connector also includes an internal shielding shell, and the internal shielding shell includes a pair of tabs disposed at two sides thereof in the transverse direction; each first side wall defines a top slit which is open downward, and each second side wall defines a bottom slit which is open upward; the top slit and the bottom slit are opposite to each other in the vertical direction, and each tab is respectively received in both the top slit and the bottom slit.

11. A cable connector assembly comprising:

an insulative housing;

a plurality of contacts disposed in the housing;

a round cable located behind the housing in a front-to-back direction and including a plurality of wires mechanically and electrically connected to the corresponding contacts, respectively;

a metallic internal shield circumferentially enclosing said housing;

a metallic external shield including a first part and a second part assembled to each other in a vertical direction perpendicular to said front-to-back direction, said first part having a first main wall, and a pair of first side walls opposite to each other in a transverse direction perpendicular to both said front-to-back direction and said vertical direction so as to cooperate with the first main wall to commonly form first U-shaped structure, said second part having a second main wall, and a pair of second side walls opposite to each other in the transverse direction to cooperate with the second main wall to commonly form a second U-shaped structure, said first U-shaped structure and said second U-shaped structure being opposite to each other in the vertical direction, the first main wall and the second main wall opposite to each other in the vertical direction, the first side walls and the corresponding second side walls intimately overlapped with each other in the traverse direction and secured to each other in the vertical direction, respectively; and a rear wall having a pair of halves spaced from each other with an opening therebetween in said transverse direction, and a tongue piece located in said opening and being coplanar with said pair of halves in the transverse direction; wherein the pair of halves extend respectively from rear edges of the corresponding second side walls toward each other while the tongue piece extends from a rear edge of the first main wall toward a rear edge of the second main wall.

12. The cable connector assembly as claimed in claim 11, wherein said tongue piece and said pair of halves commonly define a circular opening to snugly and compliantly receive therein said cable extending along the front-to-back direction.

13. The cable connector assembly as claim 11, wherein each of said pair of halves extend beyond a horizontal edge of the corresponding second side wall in the vertical direction so as to intimately confront the rear edge of the first main wall in the front-to-back direction.

14. The cable connector assembly as claimed in claim 11, wherein said internal shield forms a pair of vertical tabs extending outwardly from two opposite lateral sides in said transverse direction, and both the first side walls and the second side walls form corresponding vertical slits to allow each of the tabs to extend through the vertical slits of both the corresponding first side wall and second side wall simultaneously.

15. The cable connector assembly as claimed in claim 14, wherein each of said vertical slits extends from a horizontal edge of the corresponding first side wall or second side wall, and communicates with an exterior in the vertical direction before assembling.

16. The cable connector assembly as claimed in claim 11, further including a metallic fixing member having unitarily a circular main body surrounding the round cable, and a pair of soldering ears symmetrically formed on two sides of the main body in the transverse direction, wherein each of said soldering ears is fixed to the corresponding half.

17. A cable connector assembly comprising:

an insulative housing;

a plurality of contacts disposed in the housing;

a round cable located behind the housing in a front-to-back direction and including a plurality of wires mechanically and electrically connected to the corresponding contacts, respectively;

a metallic internal shield circumferentially enclosing said housing;

a metallic external shield including a first part and a second part assembled to each other in a vertical direction perpendicular to said front-to-back direction, said first part having a first main wall, and a pair of first side walls opposite to each other in a transverse direction perpendicular to both said front-to-back direction and said vertical direction so as to cooperate with the first main wall to commonly form first U-shaped structure, said second part having a second main wall, and a pair of second side walls opposite to each other in the transverse direction to cooperate with the second main wall to commonly form a second U-shaped structure, the first U-shaped structure being opposite to the second U-shaped structure in the vertical direction, the first main wall and the second main wall opposite to each other in the vertical direction, the first side walls and the corresponding second side walls intimately overlapped with each other in the traverse direction and secured to each other in the vertical direction, respectively; and a rear wall having a pair of halves spaced from each other with an opening therebetween in said transverse direction, and a tongue piece located in said opening and being coplanar with said pair of halves in the transverse direction; wherein said tongue piece and said pair of halves commonly define a circular opening to snugly and compliantly receive therein said cable extending along the front-to-back direction;

further including a metallic fixing member having unitarily a circular main body surrounding the round cable, and a pair of soldering ears symmetrically formed on two sides of the main body in the transverse direction, wherein each of said soldering ears is fixed to the corresponding half.

18. The cable connector assembly as claimed in claim 17, further including a metallic fixing member having unitarily a circular main body surrounding the round cable, and a pair of soldering ears symmetrically formed on two sides of the main body in the transverse direction, wherein each of said soldering ears is fixed to the corresponding half.

19. The cable connector assembly as claimed in claim 18, wherein said halves extend from rear edges of the corresponding first side walls to each other in the transverse direction, respectively.

20. The cable connector assembly as claimed in claim 17, wherein said internal shield forms a pair of vertical tabs extending outwardly from two opposite lateral sides in said transverse direction, and both the first side walls and the second side walls form corresponding vertical slits to allow each of the tabs to extend through the vertical slits of both the corresponding first side wall and second side wall simultaneously; wherein each of said vertical slits extends from a horizontal edge of the corresponding first side wall or second side wall, and communicates with an exterior in the vertical direction before assembling.

* * * * *